United States Patent [19]

Craig et al.

[11] 4,024,979

[45] May 24, 1977

[54] HANDLING RING FOR PLASTIC DRUM

[75] Inventors: Walter J. Craig, Crest Hill; Walter K. Lewis, New Lenox; Rondell L. Bailey, Chicago, all of Ill.

[73] Assignee: Plasti-Drum Inc., Lockport, Ill.

[22] Filed: June 30, 1975

[21] Appl. No.: 591,505

[52] U.S. Cl. ..... 220/71; 220/5 R; 220/85 K

[51] Int. Cl.[2] ..... B65D 7/42; B65D 7/02; B65D 25/00

[58] Field of Search ..... 220/72, 71, 5 R, 85 R, 220/85 K

[56] References Cited

UNITED STATES PATENTS

| | | | |
|---|---|---|---|
| 1,314,445 | 8/1919 | Wacker | 220/71 |
| 2,826,330 | 3/1958 | Imparato | 220/71 |
| 3,647,110 | 3/1972 | Hammes | 220/72 |

*Primary Examiner*—William Price
*Assistant Examiner*—Steven M. Pollard
*Attorney, Agent, or Firm*—Edward D. Gilhooly

[57] ABSTRACT

A handling element for a container such as a cylindrical drum to permit manipulation of the container by conventional handling equipment. The handling element is secured within a groove or ridge formed in the container and is situated at a position to allow the handling equipment to contact the ring and lift and otherwise manipulate the container. The element includes a lower support surface and an upper lateral surface to operatively cooperate with conventional equipment for manipulation.

3 Claims, 2 Drawing Figures

HANDLING RING FOR PLASTIC DRUM

BACKGROUND OF THE INVENTION

This invention relates in general to containers such as drums and in particular, to an improved handling device to effect manipulation and handling of a container.

More specifically, this invention relates to a container having a handling element which permits conventional equipment to lift and manipulate it in a safe and effective manner. The container is provided with a groove or ridge situated at an appropriate height and includes an element secured on the groove, ridge or other means which can be readily grasped by the handling device.

It is common practice to store, ship or otherwise handle material of all forms within containers, particularly in the form of large metal drums and the like. Through the years various types of handling equipment have been developed which permit movement, manipulation, and storage of such containers without requiring manual labor. A particularly useful form of equipment which has evolved for manipulation of these drums is a mobile device which has a drum contacting head to grasp a drum at an upper flange. Such a handling device is designed to cooperate with the upper flange formed on the conventional metal drum which permits the equipment to grasp the drum and safely manipulate and move it as an operator desires.

One commercial handler device which has been designed to contact and grasp the upper flange of such metal drums is sold under the trademark Lift-O-Matic and is a drum handler which has achieved great popularity in the field because of its effectiveness, versatility and ease of operation. However, many types of containers have been developed which because of their material or design are not provided with the upper flange with which the previously discussed metal drums are provided. This makes it impossible for equipment such as the Lift-O-Matic drum handler to be used in conjunction with these other types of containers which may be formed of plastic, fibre, metal or any other suitable substance. Because handlers of the Lift-O-Matic design are in widespread use, the absence of a suitable element that is provided in conventional steel drums for hooking presents significant difficulties in manipulating these other types of containers.

SUMMARY OF THE INVENTION

It is, therefore, an object of this invention to increase the adaptablility of certain types of containers to be manipulated by conventional handlers.

Another object of this invention is to provide drums with a handler element to allow it to be manipulated by greater variety of equipment.

A further object of this invention is to mount a handler ring within a flange of a container for effective and safe handling.

These and other objects are attained in accordance with the invention wherein there is provided a container such as in the form of a cylindrical drum or other suitable shape which is provided with a groove or ridge suitably placed around the drum to receive the improved handler element of the invention. The handler element is so designed that typical drum handling equipment can easily grasp the element for lifting and other manipulation. The element may be made from any suitable material such as metal and the like and may be molded, fabricated or extruded. The handling ring permits certain types of containers formed from plastic and the like and not having a conventional flange to be safely lifted and manipulated by common handling equipment. The design of the drum handler element of the invention permits these drums to be safely manipulated by such prior art equipment in an effective manner.

BRIEF DESCRIPTION OF THE DRAWINGS

Further objects of the invention, together with additional features contributing thereto and advantages accruing therefrom, will be apparent from the following description of an embodiment of the invention when read in conjunction with the accompanying drawings, wherein.

DESCRIPTION OF A PREFERRED EMBODIMENT

Figure 1:
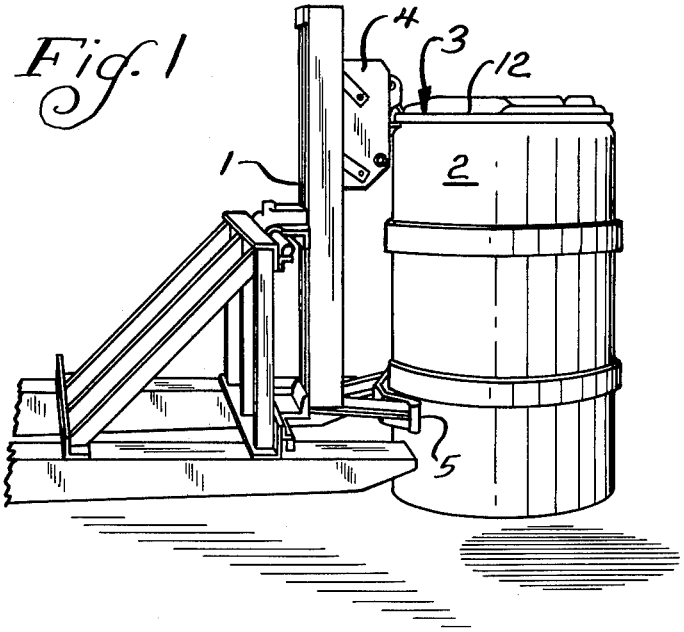
FIG. 1 is a perspective illustration of a conventional container handling device manipulating a drum incorporating the improved handling feature of the invention.
Figure 2:
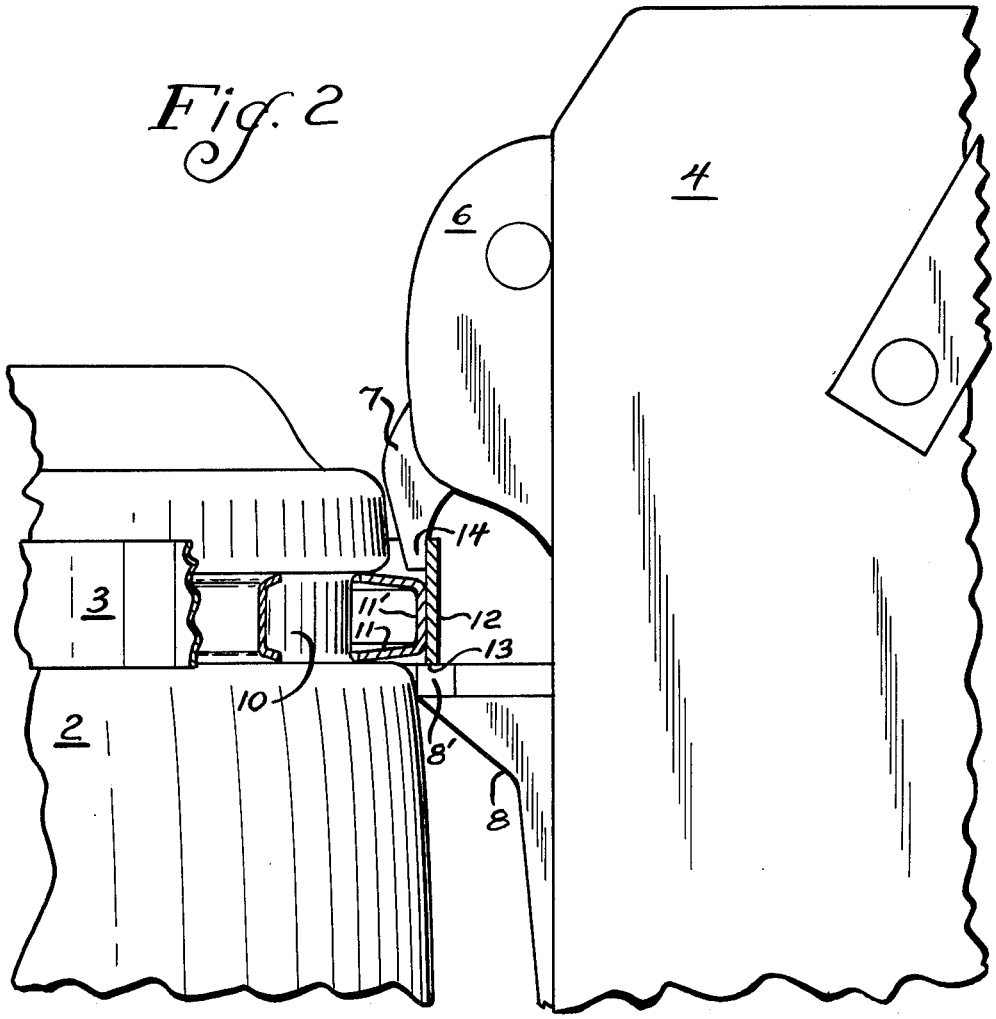
FIG. 2 is an enlarged side schematic illustration with parts broken away of conventional drum handling equipment in operative contact with the drum handling feature of the invention positioned on a container.

Referring now to FIGS. 1 and 2 there is shown conventional drum handling equipment 1 which is mounted for movement on a suitable vehicle for lifting and manipulating a drum 2 by contact with drum handling element 3 of the invention. The drum handler 1 is only illustrative of conventional equipment used for manipulating containers and the invention is not limited for use with such a device. Moreover, although the drum 2 is shown in the shape of a cylindrical drum, it should be apparent to one skilled in the art that the drum could encompass many other shapes which are conventional for such containers. Also, drum 2 as illustrated can be fabricated from a plastic, fibre, metal or any other substance suitable for containers used for material storing, transporting and other uses.

The handling element 3 provided on drum 2 is suitably situated on the exterior of the drum so that the handler 1 can effectively engage the element for lifting of the drum and the like. Generally, handler 1 includes a movable lifting head 4 having a mounting bracket 6 to support an upper "beak" like projection 7. The lifting head 4 further includes a lower support element 8 having an upper contact support 8'. The cooperation of the projection 7 and contact support 8 on a flanged area of a drum permits its manipulation as desired. Handler 1 also is provided with a lower brace 5 to stabilize lifting of the drum during operation.

Handling element 3 of the invention is secured within a flange 10 formed around the exterior surface of the drum at a suitable location. The handling element can also be attached to the drum on a ridge (not shown) formed thereon or by securement means (not shown) projecting through the drum. The flange can be of any cross-sectional shape to adequately support handling element 3. Handling element 3 is provided with an inner ring member 11 of any suitable material which can be molded, fabricated or extruded including metals, plastics and the like. Although the element 11 is shown with an open U-shape having an outer surface 11; it is within the scope of the invention to utilize other shapes for the inner ring element 11. In the embodiment shown in FIGS. 1 and 2 the ring element extends around the entire circumference of the container 2 although the ring element could be in short segments of selected arcular extends.

As best shown in FIG. 2 inner ring 11 supports an outer ring 12 having a surface projecting beneath and above inner ring 11. Ring 12 is attached to inner ring 11 by a suitable securement technique such as spot welding and the like. Ring 12 can be constructed of a similar material as inner ring 11 and possess a configuration that provides a bottom surface 13 and an inner surface 14 which is spaced from the surface of container 2.

The securement of the handler 1 to the handler element 3 of the invention for manipulation is clearly shown in FIG. 2 whereby the projection 7 of the handler is inserted between the outer surface of drum 2 and outer ring 12 and a surface of the projection 7 contacts ring 12 at area 14. At the same time, the lower support surface 8 of handler 1 contacts and supports the bottom of ring 13 whereby element 4 can be raised or lowered with the drum secured thereto for manipulation. Thus, the handling element of the invention provides a capability for drums not having a "built-in flange" provided in many metal drums to be manipulated by different types of handling equipment to increase its versatility and effectiveness in use.

While the invention has been described with reference to a preferred embodiment, it will be understood by those skilled in the art that various changes may be made and equivalents may be substituted for elements thereof without departing from the true spirit and scope of the invention. In addition, many modifications can be made to adapt a particular situation and material to the teaching of the invention without departing from its essential teachings.

What is claimed is:

1. A container comprising body means having a longitudinal axis and forming a container for receiving material, said body means including an exterior handling means disposed substantially transverse to said longitudinal axis and having at least one surface adapted to be grasped by equipment to manipulate the body means, the exterior handler means includes a handler element having two surfaces lying in perpendicular planes to be grasped by equipment to manipulate the body means, said handler element includes a bottom surface and upper side surface, said upper side surface is disposed confronting said body means in spaced relation thereto, said handler element comprises a ring lying in surrounding relationship to the body means, the handler element is supported in support means formed on said body means, said handler element including a support member attached to said ring and coupled to said support means to support the body means at least in a direction substantially parallel to said longitudinal axis when equipment manipulates the body means, and said support member supporting the handler element in spaced relationship to the body means and comprising a U-shaped configuration.

2. The container of claim 1 wherein the support means comprises a groove formed on the exterior of the body means to receive the exterior handler means.

3. The container of claim 2 wherein the groove extends around the body means.

* * * * *

Disclaimer 4,024,979.—*Walter J. Craig,* Crest Hill; *Walter K. Lewis,* New Lenox; and *Rondell L. Bailey,* Chicago, Ill. HANDLING RING FOR PLASTIC DRUM. Patent dated May 24, 1977. Disclaimer filed Oct. 29, 1982, by the assignee, *Plasti-Drum, Inc.*

Hereby enters this disclaimer to claims 1 to 3 of said patent.

[*Official Gazette December 21, 1982.*]